US008109102B2

(12) United States Patent
Lifson et al.

(10) Patent No.: US 8,109,102 B2
(45) Date of Patent: Feb. 7, 2012

(54) ADJUSTMENT OF COMPRESSOR OPERATING LIMITS

(75) Inventors: Alexander Lifson, Manlius, NY (US); Michael F. Taras, Fayetteville, NY (US); Jason D. Scarcella, Cicero, NY (US)

(73) Assignee: Carrier Corporation, Syracuse, NY (US)

( * ) Notice: Subject to any disclaimer, the term of this patent is extended or adjusted under 35 U.S.C. 154(b) by 212 days.

(21) Appl. No.: 12/444,783

(22) PCT Filed: May 9, 2007

(86) PCT No.: PCT/US2007/068540

§ 371 (c)(1), (2), (4) Date: Apr. 8, 2009

(87) PCT Pub. No.: WO2008/140516

PCT Pub. Date: Nov. 20, 2008

(65) Prior Publication Data

US 2010/0101247 A1 Apr. 29, 2010

(51) Int. Cl.
*F25B 1/00* (2006.01)

(52) U.S. Cl. ..... 62/115; 62/129

(58) Field of Classification Search ..... 62/115, 62/126, 129, 228.3, 231, 208
See application file for complete search history.

(56) References Cited

U.S. PATENT DOCUMENTS

| | | | | | |
|---|---|---|---|---|---|
| 4,311,497 | A * | 1/1982 | Newell | 62/158 |
| 4,487,031 | A | 12/1984 | Rogers et al. | |
| 5,209,076 | A * | 5/1993 | Kauffman et al. | 62/126 |
| 5,379,606 | A * | 1/1995 | Katsuki et al. | 62/126 |
| 5,669,226 | A * | 9/1997 | Kurahashi et al. | 62/227 |
| 5,694,779 | A * | 12/1997 | Matsushima et al. | 62/114 |
| 5,907,957 | A | 6/1999 | Lee et al. | |
| 6,053,000 | A * | 4/2000 | Levitin et al. | 62/205 |
| 6,185,948 | B1 * | 2/2001 | Niki et al. | 62/199 |
| 6,206,652 | B1 * | 3/2001 | Caillat | 417/298 |
| 7,347,056 | B2 * | 3/2008 | Anyoji et al. | 62/133 |
| 2005/0103029 | A1 * | 5/2005 | Kawahara et al. | 62/126 |
| 2006/0005552 | A1 * | 1/2006 | Anyoji et al. | 62/133 |

OTHER PUBLICATIONS

Search Report and Written Opinion mailed on Dec. 31, 2007 for PCT/US2007/68540.
International Preliminary Report on Patentability mailed on Sep. 8, 2009.

* cited by examiner

*Primary Examiner* — Mohammad Ali
(74) *Attorney, Agent, or Firm* — Calson, Gaskey & Olds, PC

(57) ABSTRACT

A refrigerant system includes a compressor that has safe operating limits that are also built into a refrigerant system control to protect the compressor. Under certain conditions, these safe operational limits may be changed to allow the compressor to operate beyond the safety limits at least for a period of time.

20 Claims, 1 Drawing Sheet

ADJUSTMENT OF COMPRESSOR OPERATING LIMITS

This application is a United States National Phase application of PCT Application No. PCT/US2007/068540 filed May 9, 2007.

BACKGROUND OF THE INVENTION

This application relates to a method and control of a refrigerant system, wherein normal safe operating limits imposed on a compressor may be temporarily changed to allow for high load operating conditions for a relatively short period of time such as rapid cooldown of a refrigerated container or conditioned space.

Refrigerant systems are known, and typically circulate a first fluid, or so-called primary refrigerant, from a compressor, at which it is compressed, into a first heat exchanger, at which it rejects heat during heat transfer interaction with a second fluid, such as air, and then through an expansion device. The refrigerant is expanded to a lower pressure and temperature in the expansion device, and then passes to a second heat exchanger, at which it accepts heat from a third fluid to be conditioned. Typically, in an air conditioning or refrigeration system, the second heat exchanger is an indoor heat exchanger that will cool air being conditioned and delivered into a climate-controlled environment.

The above is a very simplified description of the operation of a refrigerant system, and many options and more complex arrangements would come within this basic description of a refrigerant system. One feature that is typically associated with most refrigerant systems, and compressors in particular, is safe operating limits imposed on system components. If the safe limits are exceeded for a certain period of time, there is a possibility that the compressor or other system components can be damaged. However, if the system runs only for a short period of time above the safe operating limits and/or these limits are exceeded only slightly, there might be no imminent danger to the system reliability and performance. To determine where the refrigerant system runs, with respect to safe operating limits, certain operational parameters are sensed and transmitted to the refrigerant system control. If those sensed parameters exceed safe limits, then the compressor motor may be shut down, to prevent permanent damage to the compressor.

As an example, if the temperature or pressure at the discharge of the compressor is too high, this could be indicative of a condition at which the compressor could possibly become damaged. Thus, under such conditions, most compressors are provided with a control that would stop operation should preset limits be exceeded. As with most safe limits in industrial applications, the limits are set such that the likelihood of actual damage is very low. That is, if the compressor were allowed to operate just above the established safe limit for a period of time, in the majority of cases, there will not be any damage. Still, the safe limits are important over the life of a refrigerant system to prevent damage to its components, and in a particular, the compressor.

On the other hand, there are times when a compressor would be prone to operate near or above the imposed discharge temperature or pressure safe limits. These conditions may occur, for example, when initially cooling down a climate-controlled environment under high ambient temperature conditions. In the past, when the safe operating limits where exceeded, regardless of the mode of operation or ambient temperature, the amount by which the safe limit is exceeded, or the time the compressor is expected to operate above the safe limit, the refrigerant system was shutdown. The refrigerant system shutdown would often lead to the food spoilage, loss of expensive cargo or prolonged time intervals of discomfort in the conditioned space.

SUMMARY OF THE INVENTION

In the disclosed embodiment of this invention, a method and control for controlling a compressor in a refrigerant system allows either for changing or temporary elimination of the safe limits for the compressor under certain conditions. Thus, for example, when the pulldown is occurring at high ambient temperature conditions, the control may either change the limits to a second higher level, or could even temporary eliminate the limits. This change can be enacted manually, or could happen automatically, based upon sensed operating and environmental conditions.

The operator responsible for the unit operation may believe that, in the particular case, exceeding the safe limit and running the risk of damage to the compressor would be worthwhile, given the potential value of achieving the required temperature in a rapid manner. As an example, such a decision could be made in the case of cooling down a refrigerated container to protect a frozen cargo.

These and other features of the present invention can be best understood from the following specification and drawings, the following of which is a brief description.

DETAILED DESCRIPTION OF THE PREFERRED EMBODIMENTS

Figure 1:
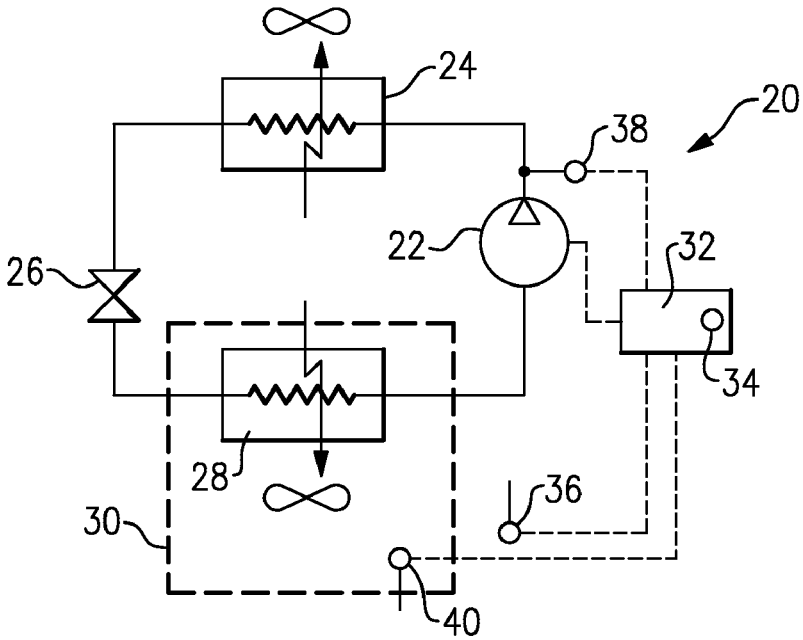
FIG. 1 is a schematic view of a refrigerant system incorporating the present invention.

FIG. 1 shows a refrigerant system 20 incorporating the present invention. As known, a compressor 22 compresses refrigerant vapor and delivers it downstream to a first heat exchanger 24 typically located outdoors for a conventional cooling refrigerant system. Air is blown over the heat exchanger 24 external surfaces by an associated air-moving device to cool the refrigerant, such that heat is transferred from refrigerant to air. During this cooling process in the heat exchanger 24, the refrigerant may undergo a phase change. From the heat exchanger 24, the refrigerant passes through an expansion device 26 where it is expanded to a lower pressure and temperature, and then through a second heat exchanger 28 typically located indoors for a conventional cooling refrigerant system. The heat exchanger 28 also has an associated air-moving device for blowing air over the heat exchanger 28 external surfaces to cool and typically dehumidify the air that is then delivered into an environment 30 to be conditioned. The conditioned environment 30 can be an interior of a building, a refrigerated container, or any other environment which would benefit from receiving conditioned air. In case of a heat pump, the roles of the heat exchangers 24 and 28 are reversed as known.

A control 32 for the compressor 22 is shown including an operator switch 34. A sensor 38 senses refrigerant temperature and/or pressure on a high pressure side of the refrigerant system 20. Those sensed parameters are communicated to the control 32, where they are compared to predefined safe operating limits. The switch 34 is operable to allow the operator to temporarily eliminate or at least change the predefined safe operating limits, associated with the compressor 22. As mentioned above, the operator for the refrigerant system 20 may decide that to rapidly pull down the temperature in the conditioned environment 30 sensed by a temperature sensor 40 is so important, it is worthwhile to run the risk of running the compressor 22 outside of predefined safe operational envelope for a short period of time. Thus, by selectively actuating the switch 34, the safe operating limits may be temporarily altered or eliminated.

As is known, safe operating limits, for example, for the discharge temperature may be on the order of 280° F., for the discharge pressure for R134a refrigerant—on the order of 330 psi, and for the saturation discharge temperature—on the order of 160° F. If the switch 34 is actuated, the control may be changed to allow these safety limits to be exceeded for a period of time. As an example, even though the discharge temperature safe limit may be initially 280° F., the control may allow the discharge temperature to run at 330° F. for a few hours while pulldown is taking place. The safe operating limits can also be set based on other measured parameters, such as the temperature of the compressor motor windings (which can be determined by direct or indirect means), oil temperature inside the compressor oil sump, compressor motor current draw, suction and discharge pressures, and temperatures inside the refrigerant system heat exchangers. The safe operating limits may also be adjusted according to the supplied power voltage and frequency.

On the other hand, it may be that a second higher operating limit level is set. As an example, there could be a second level which is 20% higher than the initial level, and this second level limit replaces the initial level limit should the switch 34 be actuated.

Alternatively, the refrigerant system control 32 may change the safety limits automatically under certain conditions. As an example, a temperature sensor 36 is shown sensing ambient temperature. If, for instance, the refrigerant system control 32 is entering a pulldown mode, and the sensed ambient temperature 36 is higher than a predefined value (e.g. 135 F), the control 32 may temporarily change the safe operating limits. The time period for this change may be based on the value by which actual operating parameters exceed the predefined safe operating limits. The higher this deviation the lower the period of time during which the refrigerant system 20 is allowed to operate outside of the safe envelope.

While particular conditions which can be sensed to automatically change the safe operating limits are disclosed, many other variables can be utilized.

As shown in FIG. 1, the temperature sensed by a temperature sensor 40 within the conditioned environment 30 may also be utilized. If that temperature is far from the target temperature, this temperature difference could be utilized to automatically change the safe operating limits. It should also be understood that, in addition to changing or overwriting the safe operating limits due to pulldown, the safe operating limits can be changed or eliminated for other reasons. For example it might be required to operate the refrigerant system while one of the component, such as for example the expansion device, is malfunctioning or being damaged, which would cause the refrigerant system to operate above the specified safe limits. In the other case, the refrigerant system may be undercharged or some of the charge may leak out, which could potentially cause the discharge temperature to exceed the specified safe operating limit. There are might be other situations where the limits may need to be exceeded, such as the need to operate the conditioned environment at extremely low temperatures.

Figure 2:
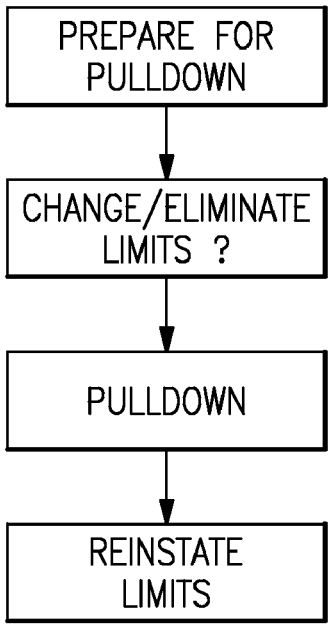
FIG. 2 is an exemplary flowchart for the present invention.

FIG. 2 is an exemplary flowchart for the basic method. As shown, for example, if it is known that the system is moving into a pulldown mode, the control would inquire whether a change in the safe operating limits is advised. This may be a result of actuation of the switch 34, or as mentioned above, could happen automatically. The system is then driven to enter a pulldown mode. After a period of time, when certain conditions are satisfied, the safe operating limits are then reinstated. As stated earlier, in addition to the pulldown, other system conditions may require elimination or change in the safe operating limits.

It should be pointed out that many different compressor types could be used in this invention. For example, scroll, screw, rotary, or reciprocating compressors can be employed.

The refrigerant systems that utilize this invention can be used in many different applications, including, but not limited to, air conditioning systems, heat pump systems, marine container units, refrigeration truck-trailer units, and supermarket refrigeration systems.

Embodiments of this invention have been disclosed. However, a worker of ordinary skill in the art would recognize that certain modifications would come within the scope of this invention. For that reason, the following claims should be studied to determine the true scope and content of this invention.

What is claimed is:

1. A refrigerant system comprising:

a compressor, said compressor compressing a refrigerant and delivering it downstream to a first heat exchanger, refrigerant from the first heat exchanger passing through an expansion device, and then through a second heat exchanger;

a control for comparing at least one monitored condition to at least one safe operating limit for the compressor, said control being operable for stopping operation of said compressor should it be determined that said at least one safe operating limit is exceeded; and said control being provided with the ability to change said at least one safe operating limit under certain conditions.

2. The refrigerant system as set forth in claim 1, wherein the control changes said at least one safe operating limit based upon an operator input.

3. The refrigerant system as set forth in claim 1, wherein said at least one safe operating limit is changed based on at least one monitored condition, where such condition is selected from a set of temperature, pressure, and electric current.

4. The refrigerant system as set forth in claim 1, wherein said at least one safe operating limit is selected from a set of compressor discharge temperature, compressor discharge pressure, compressor motor temperature, compressor motor current draw, compressor oil temperature, compressor suction pressure, saturated suction temperature, and saturated discharge temperature.

5. The refrigerant system as set forth in claim 1, wherein changing said at least one safe operating limit consists of raising this limit.

6. The refrigerant system as set forth in claim 1, wherein changing said at least one safe operating limit consists of eliminating this limit.

7. The refrigerant system as set forth in claim 1, wherein said at least one safe operating limit is changed automatically based on at least one monitored condition.

8. The refrigerant system as set forth in claim 1, wherein said at least one safe operating limit is only changed for a period of time.

9. The refrigerant system as set forth in claim 8, wherein said at least one safe operating limit is returned to its original level after a period of time.

10. The refrigerant system as set forth in claim 8, wherein said period of time is determined based on the deviation of said at least one monitored condition from said at least one safe operating limit.

11. The refrigerant system as set forth in claim 8, wherein said period of time is decreased when said deviation is increased.

12. The refrigerant system as set forth in claim 1, wherein said at least one safe operating limit is adjusted based on supplied power voltage and frequency.

13. The refrigerant system as set forth in claim 1, wherein the control changes said at least one safe operating limit at initial pull down of a space to be refrigerated.

14. A method of operating a refrigerant system comprising the steps of:

providing a compressor, compressing a refrigerant and delivering it downstream to a first heat exchanger, refrigerant from the first heat exchanger passing through an expansion device, and then through a second heat exchanger;

comparing at least one monitored condition to at least one safe operating limit for the compressor, and stopping operation of the compressor should said at least one safe operating limit be exceeded; and changing said at least one safe operating limit.

15. The method as set forth in claim 14, wherein the change to said at least one safe operating limit is based upon an operator input.

16. The method as set forth in claim 14, wherein said at least one safe operating limit is changed based on at least one monitored condition, where such condition is selected from a set of temperature, pressure, and electric current.

17. The method as set forth in claim 14, wherein changing said at least one safe operating limit consists of raising this limit.

18. The method as set forth in claim 14, wherein changing said at least one safe operating limit consists of eliminating this limit.

19. The method as set forth in claim 14, wherein said at least one safe operating limit is changed automatically based on at least one monitored condition.

20. The method as set forth in claim 14, wherein the control changes said at least one safe operating limit at initial pull down of a space to be refrigerated.

* * * * *